US009670680B2

(12) United States Patent
Jiang

(10) Patent No.: US 9,670,680 B2
(45) Date of Patent: Jun. 6, 2017

(54) FLOOR CONNECTOR AND A FLOOR WITH THE FLOOR CONNECTOR

(71) Applicant: Weiping Jiang, Zhejiang Province (CN)

(72) Inventor: Weiping Jiang, Zhejiang Province (CN)

( * ) Notice: Subject to any disclaimer, the term of this patent is extended or adjusted under 35 U.S.C. 154(b) by 0 days.

(21) Appl. No.: 15/185,154

(22) Filed: Jun. 17, 2016

(65) Prior Publication Data

US 2017/0058535 A1 Mar. 2, 2017

(30) Foreign Application Priority Data

Aug. 27, 2015 (CN) ..... 2015 1 0533294
Aug. 27, 2015 (CN) ..... 2015 1 0533295
Aug. 27, 2015 (CN) ..... 2015 1 0533305

(51) Int. Cl.
*E04F 15/02* (2006.01)

(52) U.S. Cl.
CPC .. *E04F 15/02044* (2013.01); *E04F 15/02166* (2013.01)

(58) Field of Classification Search
CPC ..... E04F 15/02044; E04F 15/02166
See application file for complete search history.

(56) References Cited

U.S. PATENT DOCUMENTS 9,140,020 B2 * 9/2015 Torres-Pinzon .. E04F 15/02044
2014/0165491 A1 * 6/2014 Lachevrotiere ... E04F 15/02044 52/489.1
2014/0260041 A1 * 9/2014 Peck ..... F16B 5/0685 52/489.1

FOREIGN PATENT DOCUMENTS

ES WO 2015150616 A1 * 10/2015 ..... E04F 13/0812
JP 5313012 B2 * 10/2013 ..... E04F 15/02044

* cited by examiner

*Primary Examiner* — Jeanette E Chapman
(74) *Attorney, Agent, or Firm* — NK Patent Law, PLLC

(57) ABSTRACT

The present invention relates to the sector of building materials, and more specifically, to a floor connector and a floor with the floor connector. The floor connector includes a first connecting part and a second connecting part used to connect floors, and a supporting part arranged between the bottom surface of the first connecting part and the upper surface of the second connecting part for the purpose of supporting the first connecting part and the second connecting part. The floor includes a main body, a floor pedestal arranged under the main body, and a floor connector used to connect the main body and the floor pedestal. In this solution, the floor can be arranged without a keel, thereby significantly reducing the labor intensity during floor installation. Consisting of three parts, the floor features lightweight and simplification of installation procedure.

8 Claims, 8 Drawing Sheets

FLOOR CONNECTOR AND A FLOOR WITH THE FLOOR CONNECTOR

CROSS-REFERENCE TO RELATED APPLICATIONS

This application claims priority to Chinese Patent Applications No. 201510533305.3 filed on Aug. 27, 2015, No. 201510533295.3 filed on Aug. 27, 2015, and No. 201510533294.9 filed on Aug. 27, 2015, the entire contents of which are incorporated by reference herein.

BACKGROUND OF THE INVENTION

1. Technical Field

The present invention relates to the sector of building materials, and more specifically, to a floor connector and a floor with the floor connector.

2. Description of Related Art

At the present day, wood-plastic composite (WPC) floors or PVC floors are more frequently used. In the prior art, a layer of keels is generally laid on the ground, and then the WPC floors are paved onto the keels during installation of wood-plastic composite floor so as to prevent dampness and high temperature, as well as fracture. However, this technology needs more working steps, being inconvenient. Currently, a host of new-type floors has been unveiled, such as the invention with the Publication Number of CN203441051U (19 Feb. 2014) discloses a floor easy to install. However, this invention uses screws to link floor pedestal, which is bound to spoil the appearance; it also causes inconvenience to screw installation as tools are needed during installation. Besides, the screws will create fixed screw holes so that the rainwater permeation may accelerate the deterioration of the floor. Another invention with the Publication Number of CN101949201A (19 Jan. 2011) discloses a WPC floor assembly which has holes for screw fixation despite a simple structure, likely to cause damage to the main body and inconvenient for installation.

An invention with the Publication Number of CN203441051U (19 Feb. 2014) discloses a floor easy to install. Although this invention has solved the problems like water swelling, cracking and deformation of wood floor, and pollution caused by formaldehyde contained in composite floor, it still uses screws to link floor pedestal, which is bound to spoil the appearance. It also causes inconvenience because of screw installation, as tools are needed during installation. Besides, the screws will create fixed screw holes so that the rainwater permeation may accelerate the deterioration of the floor.

SUMMARY OF THE INVENTION

The first objective of the present invention is to solve the above-mentioned problems by providing a floor connector, which is easy to be installed and removed and inapt to damage the floor.

The second objective of the present invention is to solve the above-mentioned problems by providing a floor, which adopts snap joint connection through which boards are directly and closely linked together and thereby the floor surface is smooth after installation.

To achieve the first technical objective, the present invention adopts the following technical solution:

A floor connector, including a first connecting part and a second connecting part used to connect floors, and a supporting part arranged between the bottom surface of the first connecting part and the upper surface of the second connecting part for the purpose of supporting the first connecting part and the second connecting part.

The lateral side of the floor connector described in the solution is shaped as symmetrical patterns like Chinese character "工" or "王", so that it helps ensure the steadiness of the whole structure. However, the shape of the floor connector can be appropriately adjusted in line with floor sharp. The floor connector described in the solution uses a snap joint to clasp the floor, so that it is inapt to damage the main body during installation, and easy to be removed. Besides, it can enhance the strength and bending resistance of the floor. In real-life process of production, WPC or steel or aluminum alloy material is preferred as these materials are easy to produce, and of better strength and bending resistance.

Preferably, the floor connecting part includes a first connecting body, and a second connecting body linked to one side of the first connecting body and symmetric with it; the length of the supporting part is less than that of the first connecting part or the second connecting part.

The first connecting body and the second connecting body are arranged symmetrically to help enhance the steadiness of the whole structure. However, the symmetric structure of the first connecting part and the second connecting part is not necessary under special condition or when it has to match the floor.

Preferably, the first connecting body is a cuboid, which features simple appearance and convenient installation.

Preferably, the first connecting body is a cuboid, and the lateral top of the cuboid extends to form a snap joint part vertical to the upper and lower surfaces of the cuboid. The snap joint part arranged plays a role in not only clamping floors, but also fastening the connection with floors, thereby making the whole structure firmer after installation.

Preferably, the snap joint part is a bar-shaped bump, which is easy to be processed and installed.

Preferably, the snap joint part includes many snap-joint units, which are designed to enhance the steadiness of joints to make the whole structure firmer after installation.

Preferably, the snap joint units are semicircular bumps, which are designed to enhance the steadiness of installation and make them easy to be removed.

Preferably, the second connecting part is arranged symmetrically with the first connecting part, which helps enhance the steadiness of the whole structure. However, the symmetric structure of the first connecting part and the second connecting part is not necessary under special condition or when it has to match a floor.

Preferably, the supporting part is a cuboid designed with bar-shaped bumps that are easy to be processed and arranged.

Preferably, more than one third parts, parallel to the first connecting part and the second connecting part, are arranged between them, the supporting part has more than one paralleling structures, and the third connecting parts and the structures parallel to the supporting part not only intensify steadiness, but also increase the attraction of the connector while changing the configuration.

To achieve the second technical objective, the present invention adopts the following technical solution:

A floor, including a main body, a floor pedestal arranged under the main body, and a floor connecting part used to connect the main body and the floor pedestal.

The floor described in this solution uses a floor connector to link the main body and the floor pedestal. In addition, a fastening part arranged between the main body and the floor pedestal provides dual protection for the installation of the floor and makes it safer. In this solution, the floor can be arranged without a keel, thereby significantly reducing the labor intensity during floor installation. Consisting of three parts, the floor features lightweight and simplification of installation procedure.

Preferably, the main body includes a floor footboard layer, a joining part arranged on each side of the floor footboard layer along width direction, and a connecting column and a fastening bar arranged under the floor footboard layer to connect and fix the floor pedestal and the floor connector. Formed by injection molding, the main body is very easy to be produced and used.

Preferably, the floor footboard layer is designed with skid resistance stripes on the upper surface for enhancing friction and preventing slip-and-fall accidents.

Preferably, the connecting column is a cuboid, and the bottom of the cuboid extends to form an extended part used to link the floor pedestal and the floor connector; the connecting column is designed as a cuboid for enhancing the strength of the main body; the extended part is formed to realize the connection with the floor pedestal or the floor connector, thus to fasten the main body and the floor pedestal.

Preferably, the floor pedestal includes a first snap joint part arranged around the floor pedestal, a second snap joint part arranged on the upper surface of the floor pedestal and linked to the connecting column, a first slideway arranged on the upper surface of the floor pedestal and fixed with the floor connector, a fastening groove arranged on the upper surface of the floor pedestal and linked to the fastening bar, and a venthole arranged under the floor pedestal. The first snap joint part and the second snap joint part are designed to connect the main body, and the venthole are designed to facilitate ventilation under the floor and prevent water entry and dampness.

Preferably, the first snap joint part includes two symmetrical ladder structures and a cuboid connected to the ladder structures; the ladder structures, the cuboid and the floor pedestal are of equal height. The side of the ladder structure deviating from the other ladder structure forms an obtuse angle with the side of the ladder structure closely connected with the floor pedestal. The obtuse angle is designed to realize the connection with the floor pedestal without any spare parts, and on the other hand, to enhance the force of friction against the floor pedestal to fasten the steadiness of floors during floor installation.

Preferably, the second snap joint part includes a cuboid, and a supporting part arranged on one side where the cuboid deviates from the center of a floor pedestal for the purpose of supporting the cuboid; there is an extended section on the top of the cuboid and close to the center of the floor pedestal in horizontal direction, and the extended section is formed to realize the connection between the second snap joint part and the connecting column, thus to fasten the main body and the floor pedestal. The supporting part is arranged to fasten the second snap joint part, and on the other side, to enlarge the friction area with the connecting column and increase the steadiness of the floor after installation.

Preferably, the floor connector is bar-shaped, and the floor connector is arranged with a groove clamped with an extended part and a first slideway. The floor connector can be used not only to connect the main body and the floor pedestal, but also to increase the hardness, bending resistance performance and firmness of the floor thanks to the use of the floor connector.

Preferably, the floor pedestal is designed with hollow-out style; the hollow-out style not only can reduce materials, increase ventilation and facilitate water permeability, but also can avoid the deformation due to thermal expansion and chilling shrink caused by weather changes.

Preferably, the main body, the floor connector and the floor pedestal form a floor unit, and the floor is formed by one or more floor units spliced through the first snap joint part. To sum up, the present invention can bring the following beneficial effects: 1. The present invention provides a floor connector featuring simple structure, convenience of production and low cost. 2. The present invention provides a floor connector. By forming some fixed geometries on the floor connector for connecting and fixing purposes, it not only avoids damage to the floor during use, but also brings convenience to installation; it simplifies the traditional procedure of floor installation. The use of the floor connector increases the crushing resistance and bending resistance of the floor, as well as its hardness. In addition, it creates more comfortable using experience. 3. The present invention provides a floor, which can solve problems like water swelling, cracking and deformation of wood floor, and pollution caused by formaldehyde contained in composite floor; 4. The present invention provides a floor, which is easy to be arranged and removed thanks to its simple structure and lightweight body; 5. The present invention provides a floor, which introduces a steel floor connector into its structure to enhance the steadiness, strength and bending resistance of the floor; 6. The present invention provides a floor, in which the floor pedestal is designed with hollow-out style with a venthole in it to reduce materials, increase ventilation, facilitate water permeability, and avoid the deformation due to thermal expansion and chilling shrink.

Figure 1:
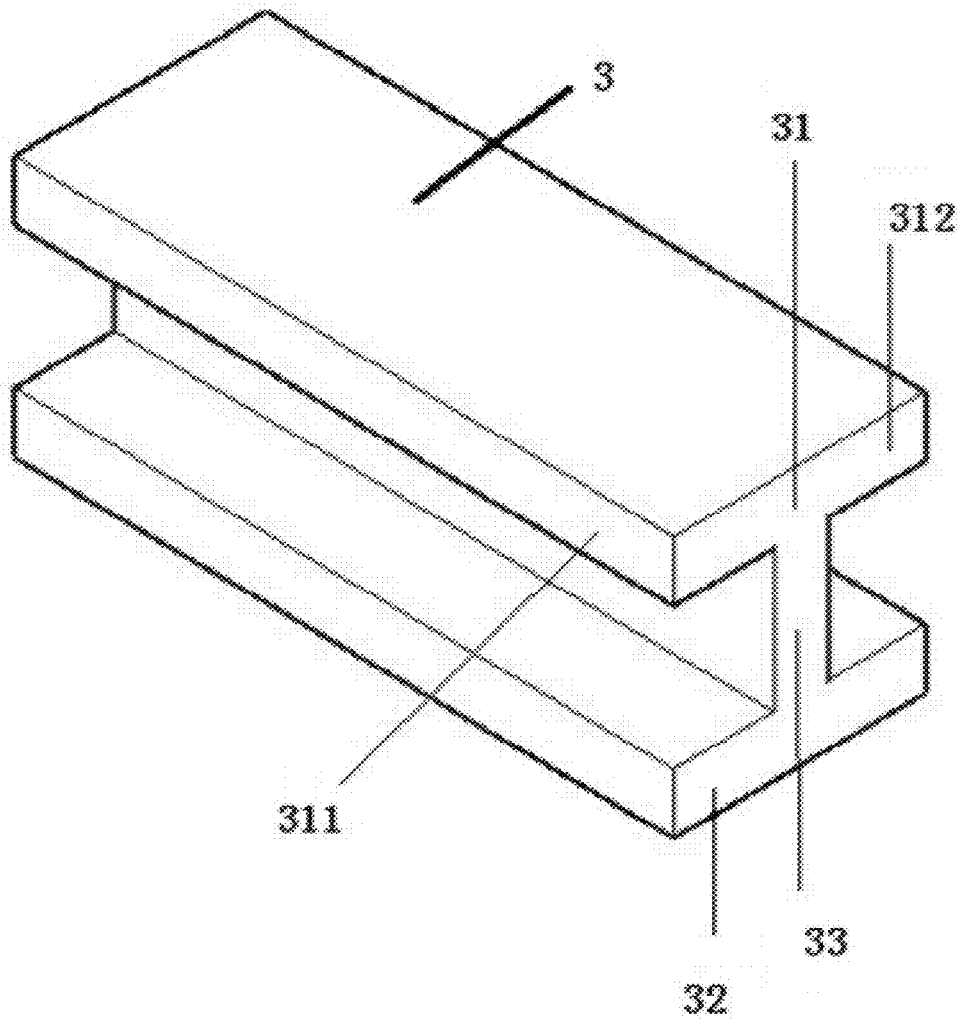
FIG. 1 is a structural diagram of the floor connector according to the present invention.

In the figures: 1—main body, 2—floor pedestal, 3—floor connector, 11—floor footboard layer, 12—joining part, 13—connecting column, 14—fastening bar, 21—first snap joint part, 22—second snap joint part, 23—first slideway, 24—fastening groove, 25—venthole. 31—first connecting part, 32—second connecting part, 33—supporting part, 34—third connecting part, 311—first connecting body, 312—second connecting body.

DETAILED DESCRIPTION OF THE INVENTION

The present invention is further detailed in combination with the drawings as follows.

Embodiment 1

As shown in FIG. 31, a floor connector, including a first connecting part 31 and a second connecting part 32 used to connect floors, and a supporting part 33 arranged between the bottom surface of the first connecting part 31 and the upper surface of the second connecting part 32 for the purpose of supporting the first connecting part 31 and the second connecting part 32.

The floor connector described in this solution is used to clasp floor, so that it is inapt to damage the main body during installation, and easy to be removed. Besides, it can enhance the strength and bending resistance of the floor.

The first connecting part 31 includes a first connecting body 311, and a second connecting body 312 linked to one end of the first connecting body 311 and symmetrically arranged to the first connecting body 311. The symmetrical arrangement of the first connecting part 311 and second connecting part 312 helps enhance the steadiness of the whole structure. Preferably, the first connecting body 311 is a cuboid, which features simple appearance and convenience for installation.

The second connecting part 32 is arranged symmetrically with the first connecting part 31 first connecting part 31 which helps enhance the steadiness of the whole structure.

The supporting part 33 is a cuboid designed with bar-shaped bumps that are easy to be processed and arranged.

It only needs to install the floor, and then insert the floor connector into the designated location for use.

Embodiment 2

Figure 2:
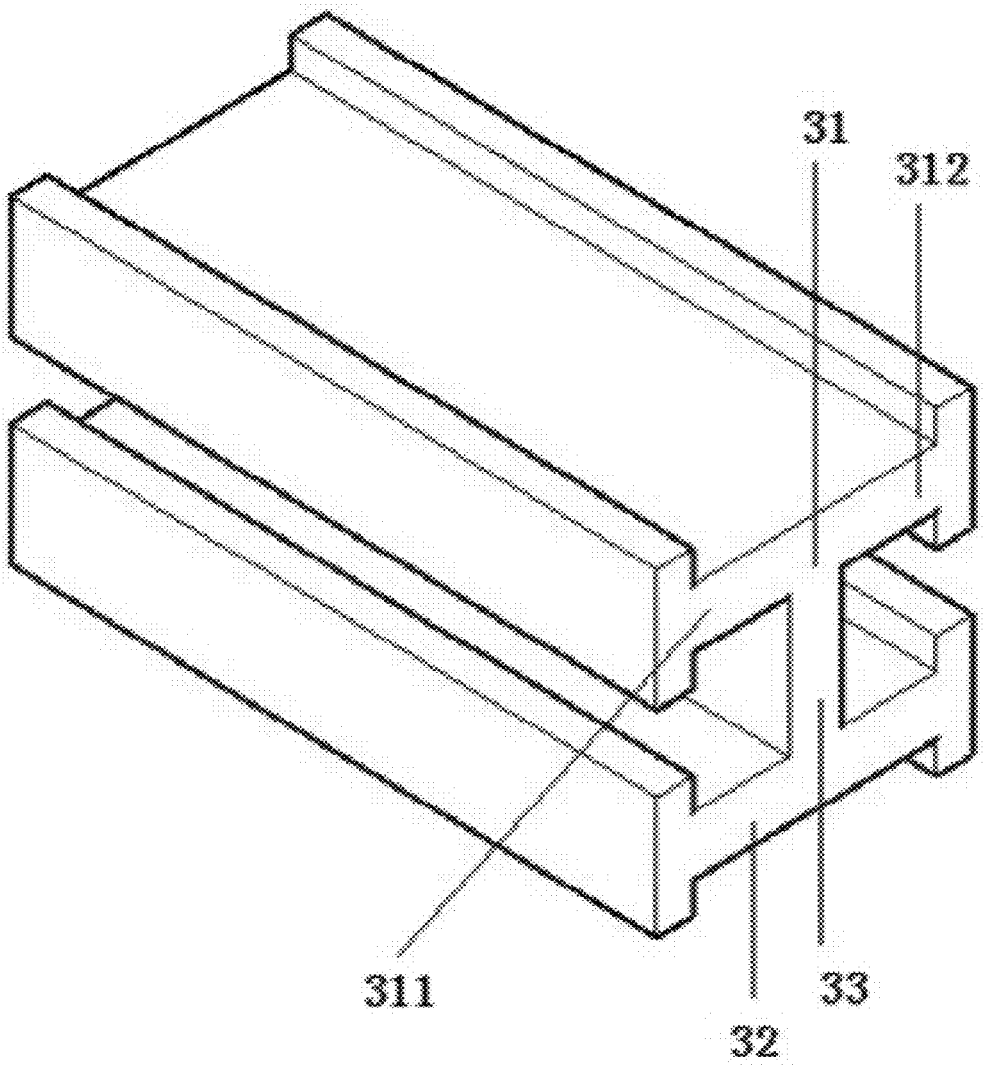
FIG. 2 is a structural diagram of the floor connector according to the present invention.

As shown in FIG. 2, a floor connector, including a first connecting part 31 and a second connecting part 32 used to connect floors, and a supporting part 33 arranged between the bottom surface of the first connecting part 31 and the upper surface of the second connecting part 32 for the purpose of supporting the first connecting part 31 and the second connecting part 32.

The floor connector described in this solution is used to clasp floor, so that it will not cause damage the main body during installation, and is easy to be removed. Besides, it can enhance the strength and bending resistance of the floor.

The first connecting part 31 includes a first connecting body 311, and a second connecting body 312 linked to one end of the first connecting body 311 and symmetrically arranged to the first connecting body 311. The symmetrical arrangement of the first 311 and second 312 connecting parts helps enhance the steadiness of the whole structure.

The first connecting body 311 is a cuboid, and the top of the cuboid extends to form a snap joint part vertical to the upper and lower surfaces of the cuboid. The snap joint part arranged plays a role in not only clamping floors, but also fastening the connection between floors, thereby making the whole structure firmer after installation. The snap joint part is a bar-shaped bump, which is easy to be processed and arranged.

The second connecting part 32 is arranged symmetrically to the first connecting part 31, which helps enhance the steadiness of the whole structure.

The supporting part 33 is a cuboid designed with bar-shaped bumps that are easy to be processed and arranged.

It only needs to install the floor, and then insert the floor connector into the designated location for use.

Embodiment 3

Figure 3:
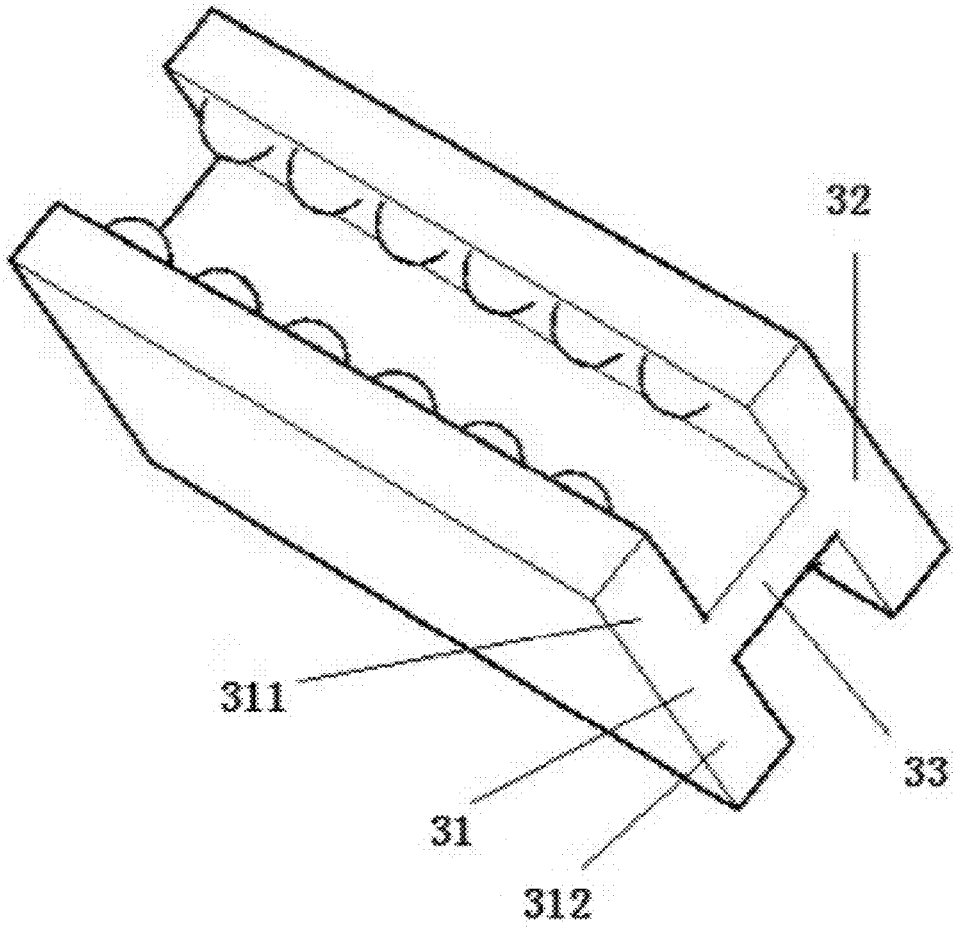
FIG. 3 is a structural diagram of the floor connector according to the present invention.

As shown in FIG. 3, a floor connector, including a first connecting part 31 and a second connecting part 32 used to connect floors, and a supporting part 33 arranged between the bottom surface of the first connecting part 31 and the upper surface of the second connecting part 32 for the purpose of supporting the first connecting part 31 and the second connecting part 32.

The floor connector described in this solution is used to clasp floor, so that it is inapt to damage to the main body during installation, and easy to be removed. Besides, it can enhance the strength and bending resistance of the floor.

The first connecting part 31 includes a first connecting body 311, and a second connecting body 312 connected to one end of the first connecting body 311 and symmetrically with the first connecting body 311. The symmetrical arrangement of the first 311 and second 312 connecting parts helps enhance the steadiness of the whole structure.

The first connecting body 311 is a cuboid, and the top of the cuboid extends to form a snap joint part vertical to the upper and lower surfaces of the cuboid. The snap joint part arranged plays a role in not only clamping floors, but also fastening the connection between floors, thereby making the whole structure firmer after installation.

The snap joint part includes many snap-joint units, which are designed to enhance the steadiness of joints to make the whole structure firmer after installation. The snap joint units are semicircular bumps, which are designed to enhance the steadiness of installation and make it easy to be removed.

The second connecting part 32 is arranged symmetrically with the first connecting part 31, which helps enhance the steadiness of the whole structure.

The supporting part 33 is a cuboid designed with bar-shaped bumps that are easy to be processed and arranged.

It only needs to install the floor, and then insert the floor connector into the designated location for use.

Embodiment 4

Figure 4:
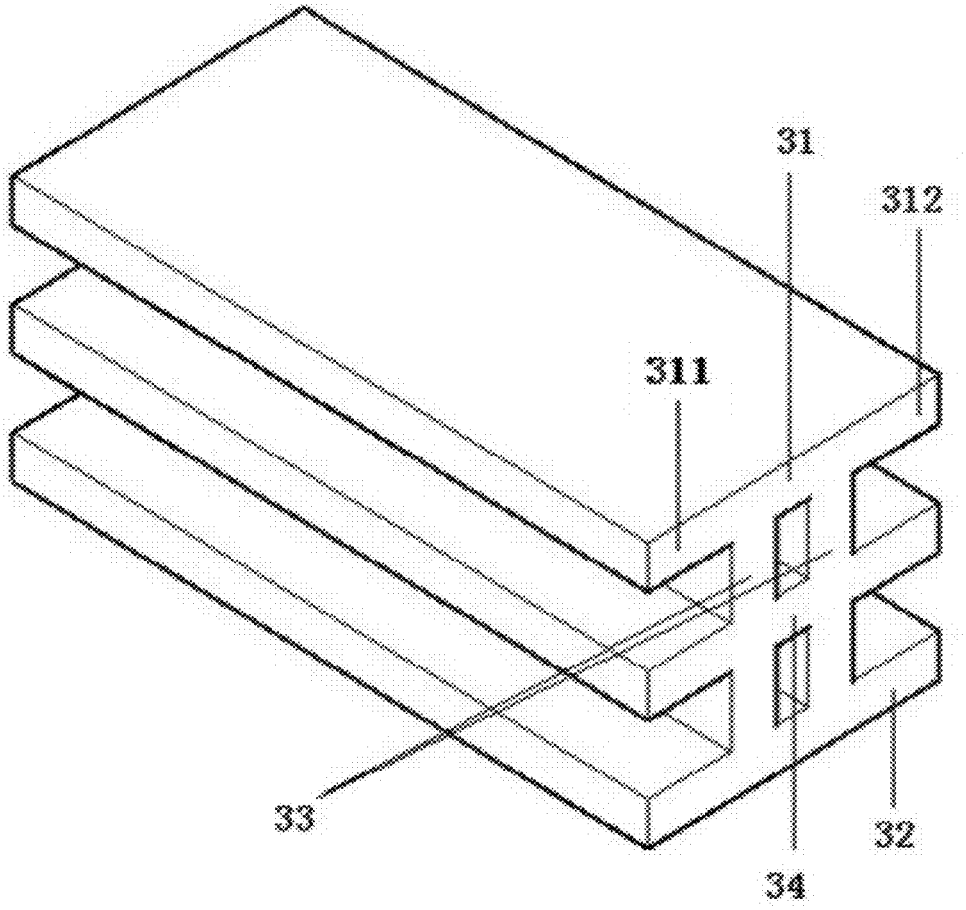
FIG. 4 is a structural diagram of the floor connector according to the present invention.
Figure 5:
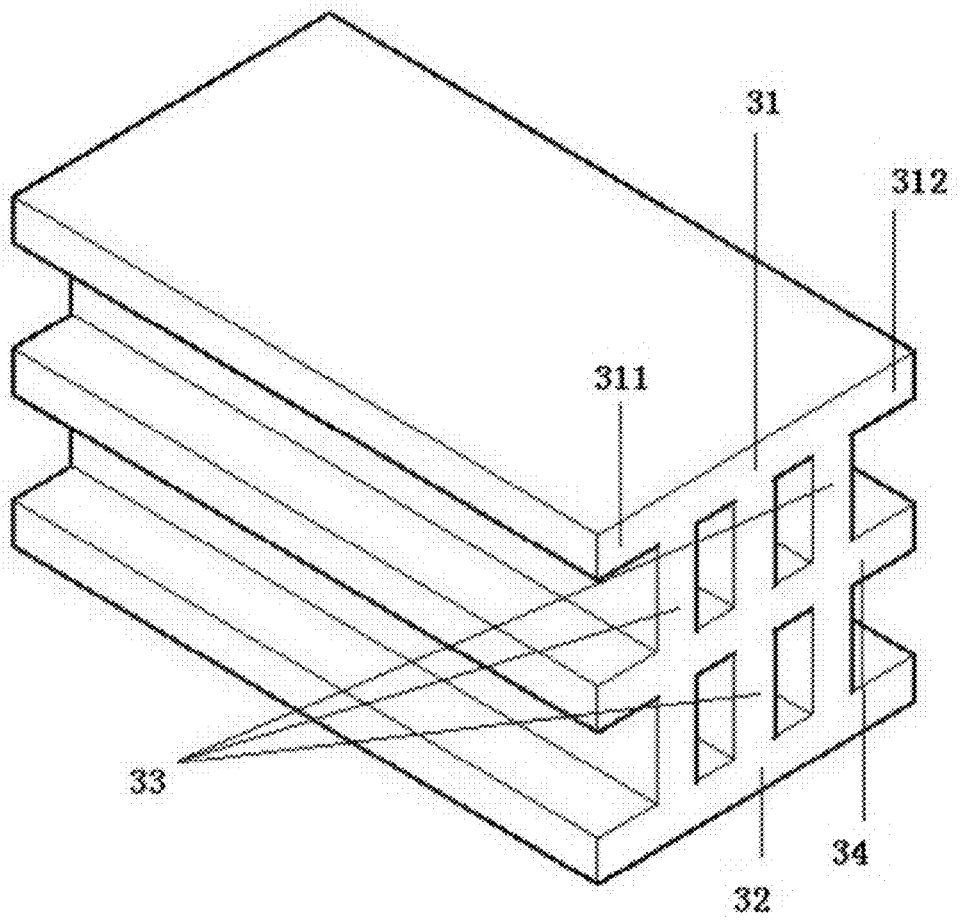
FIG. 5 is a structural diagram of the floor connector according to the present invention.

As shown in FIG. 4 or FIG. 5, a floor connector, including a first connecting part 31 and a second connecting part 32 used to connect floors, and a supporting part 33 arranged between the bottom surface of the first connecting part 31 and the upper surface of the second connecting part 32 for the purpose of supporting the first connecting part 31 and the second connecting part 32.

The floor connector described in this solution is used to clasp floor, so that it is inapt to damage to the main body during installation, and easy to be removed. Besides, it can enhance the strength and bending resistance of the floor.

The first connecting part 31 includes a first connecting body 311, and a second connecting body 312 linked to one end of the first connecting body 311 and symmetrically arranged with the first connecting body 311. The symmetrical arrangement of the first 311 and second 312 connecting parts helps enhance the steadiness of the whole structure. Preferably, the first connecting body 311 is a cuboid, which features simple appearance and convenience for installation.

The second connecting part 32 is arranged symmetrically with the first connecting part 31, which helps enhance the steadiness of the whole structure.

The supporting part 33 is a cuboid designed with bar-shaped bumps that are easy to be processed and arranged.

More than one third parts 34, parallel to the first connecting part 31 and the second connecting part 32, are arranged between them, and the supporting part 33 has more than one paralleling structures.

It only needs to install the floor, and then insert the floor connector into the designated location for use.

Embodiment 5

Figure 6:
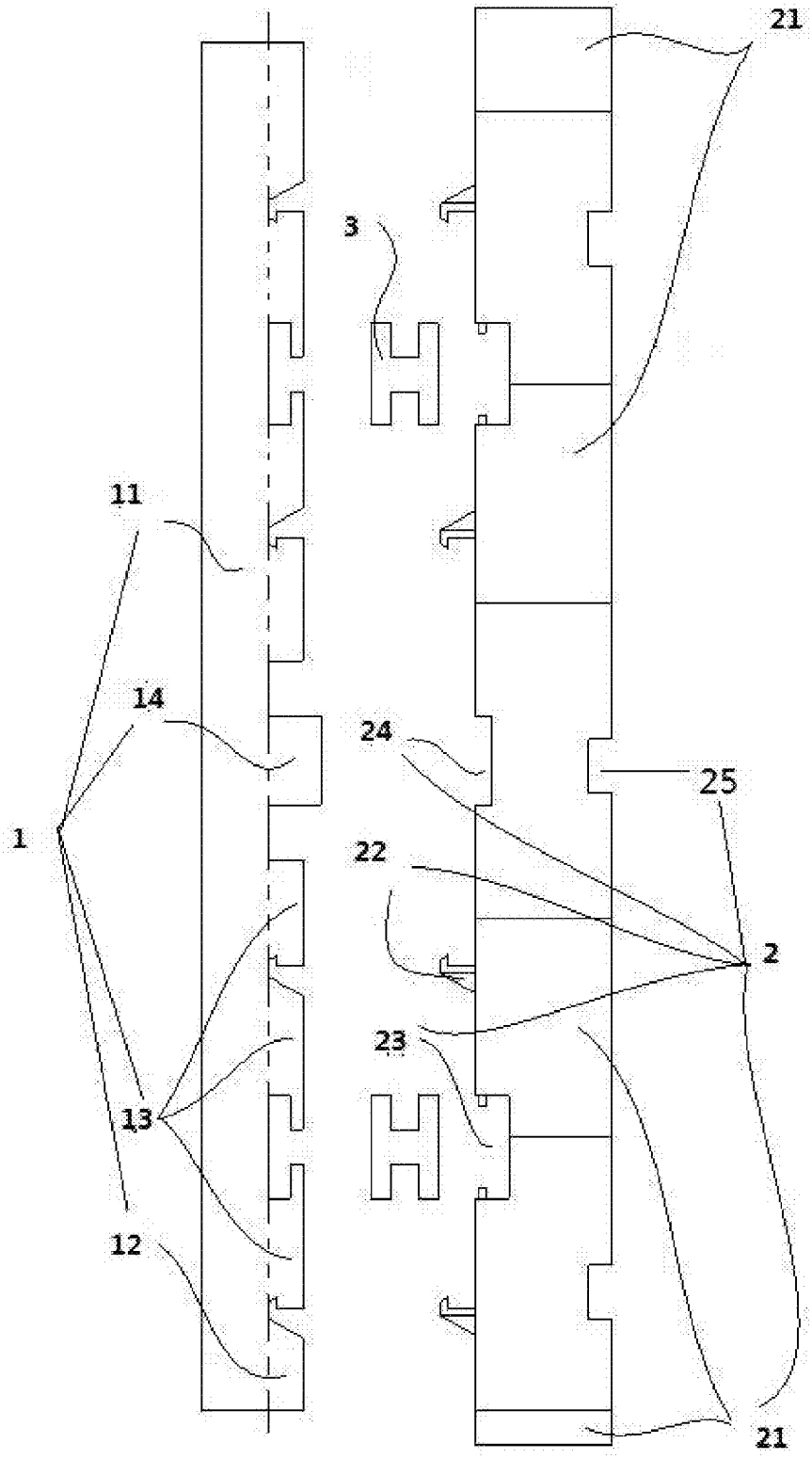
FIG. 6 is a right view of the floor according to the present invention.

As shown in FIG. 6, a floor, including a main body 1, a floor pedestal 2 arranged under the main body 1, and a floor connector 3 used to connect the main body 1 and the floor pedestal 2.

The floor described in this solution uses the floor connector 3 to connect the main body 1 and the floor pedestal 2. In addition, a fastening part arranged between the main body 1 and the floor pedestal 2 provides dual protection for the installation of the floor and makes it safer. In this solution, the floor can be arranged without a keel, thereby significantly reducing the labor intensity during floor installation. Consisting of three parts, the floor features lightweight and simplification of installation procedure.

Figure 7:
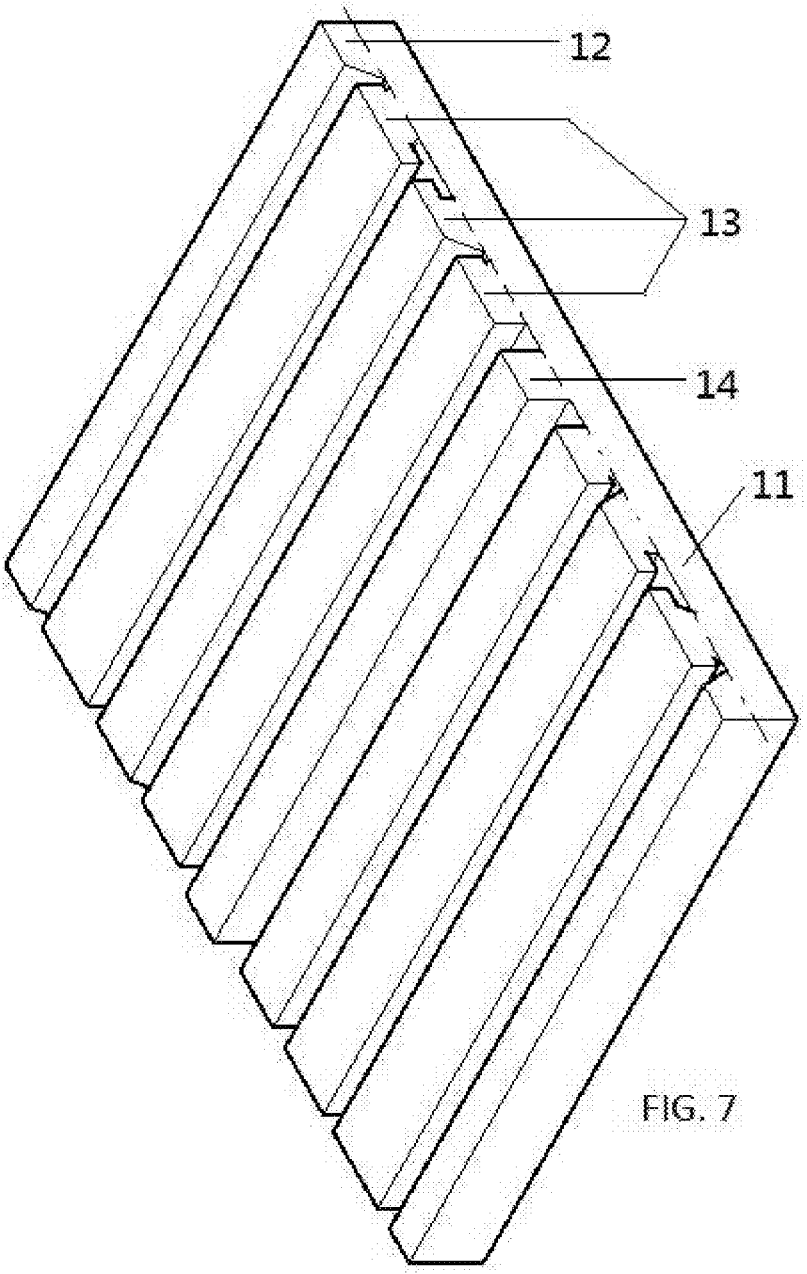
FIG. 7 is a structural diagram of the floor according to the present invention.

As shown in FIG. 7, the main body 1 includes a floor footboard layer 11, a joining part 12 arranged on each side of the floor footboard layer 11 in width direction, and a connecting column 13 and a fastening bar 14 arranged under the floor footboard layer 11 to connect and fix the floor pedestal 2 and the floor connector 3. Adopting injection molding technique, the main body 1 is easy to be produced and used.

The floor footboard layer 11 is designed with skid resistance stripes on the surface for enhancing friction and preventing slip-and-fall accidents.

The connecting column 13 is a cuboid, and the bottom of the cuboid extends to form an extended part used to link the floor pedestal 2 and the floor connector 3; the connecting column 13 is designed as a cuboid for enhancing the strength of the main body 1; the extended part is formed to realize the connection with the floor pedestal 2 or the floor connector 3, thus to fasten the main body 1 and the floor pedestal 2.

Figure 8:
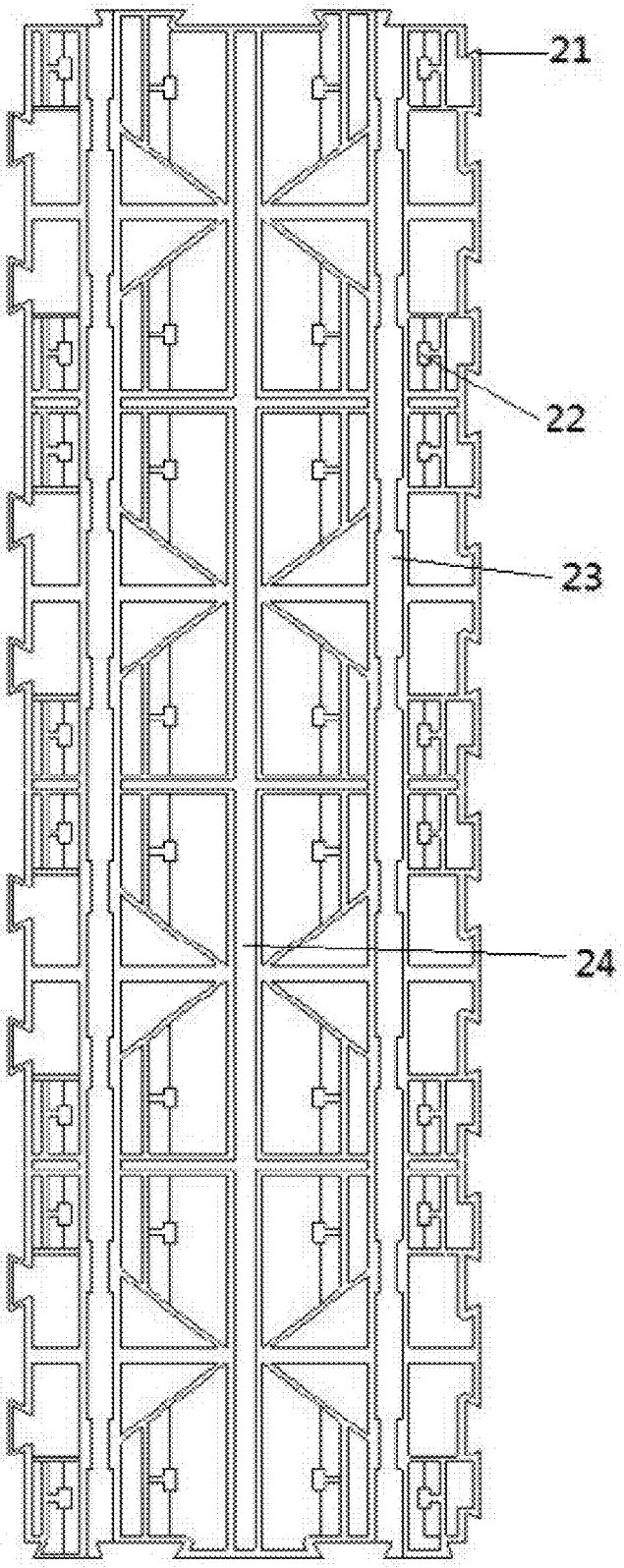
FIG. 8 is a top view of the floor pedestal according to the present invention.

As shown in FIG. 8, the floor pedestal 2 includes a first snap joint part 21 arranged around the floor pedestal 2, a second snap joint part 22 arranged on the upper surface of the floor pedestal 2 and linked to the connecting column 13, a first slideway 23 arranged on the upper surface of the floor pedestal 2 and fixed with the floor connector 3, a fastening groove 24 arranged on the upper surface of the floor pedestal 2 and linked to the fastening bar 14, and a venthole 25 arranged under the floor pedestal 2. The first snap joint part 21 and the second snap joint part 22 are designed to connect the main body 1, and the ventholes 25 are designed to facilitate ventilation under the floor and prevent water entry and dampness.

The first snap joint part 21 includes two symmetrical ladder structures and a cuboid connected to the ladder structures; the ladder structures, the cuboid and the floor pedestal 2 are of equal height; the side of the ladder structure deviating from the other side of the ladder structure and the side of the ladder structure closely linked with the floor pedestal 2 form an obtuse angle. The obtuse angle is designed to realize the connection with floor pedestal 2 without any spare parts, and on the other hand, to enhance the force of friction against the floor pedestal 2 to fasten the steadiness of the floor during floor installation.

The second snap joint part 22 includes a cuboid, and a supporting part arranged on one side where the cuboid deviates from the center of the floor pedestal 2 for the purpose of supporting the cuboid; there is an extended section on the top of the cuboid and close to the center of the floor pedestal 2 in horizontal direction, and the extended section is formed to realize the connection between the second snap joint part 22 and the connecting column, thus to fasten the main body 1 and the floor pedestal 2; the supporting part is arranged to fasten the second snap joint part 22, and on the other side, to enlarge the friction area with the connecting column and increase the steadiness of floor after installation.

The floor connector 3 is bar-shaped, and the floor connector 3 is arranged with a groove clamped with the extended part and the first slideway 23. The floor connector 3 can be used not only to connect the main body 1 and the floor pedestal 2, but also to increase the hardness, bending resistance and firmness of the floor thanks to the use of the floor connector 3.

The floor pedestal 2 is designed with hollow-out style; the hollow-out style not only can reduce materials, increase ventilation and facilitate water permeability, but also can avoid the deformation due to thermal expansion and chilling shrink caused by weather changes.

The main body 1, the floor connector 3 and the floor pedestal 2 form a floor unit. The floor is formed by one or more floor units spliced through the first snap joint part 21.

During installation of the floor, it only needs to lay the floor pedestal 2, then connect the floor connector 3 and the floor pedestal 2, and finally lay the main body 1 onto the floor pedestal 2 and the floor connector 3.

The embodiments are only given to explain the present invention, but not intended to limit the present invention. Those skilled in this art can make uncreative modifications to the embodiments according to their demands after having read the Specification. However, the Patent Law protects all such modifications provided they are within the scope of the Claims of the present invention.

What is claimed is:

1. A floor, characterized in that it includes a main body, a floor pedestal arranged under the main body, and a floor connector used to connect the main body and the floor pedestal;

the floor connector includes a first connecting part and a second connecting part used to connect floors, and a supporting part arranged between the bottom surface of the first connecting part and the upper surface of the second connecting part for the purpose of supporting the first connecting part and the second connecting part;

wherein the main body includes a floor footboard layer, a joining part arranged on each side of the floor footboard layer along width direction, and a connecting column and a fastening bar arranged under the floor footboard layer to connect and fix the floor pedestal and the floor connector.

2. The floor as claimed in claim 1, characterized in that the first connecting part includes a first connecting body), and a second connecting body linked to one side of and mounted symmetrically with the first connecting body; the length of the supporting part is less than that of the first connecting part or the second connecting part.

3. The floor as claimed in claim 2, characterized in that the first connecting body is a cuboid; or the second connecting body is a cuboid, and the lateral top of the cuboid extends to form a snap joint part vertical to the upper and lower surfaces of the cuboid.

4. The floor as claimed in claim 2, characterized in that the first connecting part is symmetric with the second connecting part; more than one third parts, parallel to the first connecting part and the second connecting part, are arranged between them, and the supporting part has more than one paralleling structures.

5. The floor as claimed in claim 1, characterized in that the floor pedestal includes a first snap joint part arranged around the floor pedestal, a second snap joint part arranged on the upper surface of the floor pedestal and linked to the connecting column, a first slideway arranged on the upper surface of the floor pedestal and fixed with the floor connector, a fastening groove arranged on the upper surface of the floor pedestal and linked to the fastening bar, and a venthole arranged under the floor pedestal.

6. The floor as claimed in claim 5, characterized in that the first snap joint part includes a symmetric ladder structure and a cuboid used to link the ladder structure; the ladder structure, the cuboid and the floor pedestal are of equal height; the side of the ladder structure deviating from the other ladder structure forms an obtuse angle with the side of the ladder structure closely linked with the floor pedestal.

7. The floor as claimed in claim 5, characterized in that the connecting column is a cuboid, and the bottom of the cuboid extends to form an extended part used to link the floor pedestal and the floor connector; the floor connector is bar-shaped, and the floor connector is provided with a groove clamped with the extended part and the first slideway.

8. The floor as claimed in claim 5, characterized in that the main body, the floor and the floor pedestal jointly form a floor unit, the floor is composed of one or more floor units spliced through the first snap joint part.

* * * * *